United States Patent [19]

Deckard

[11] Patent Number: 4,527,737

[45] Date of Patent: Jul. 9, 1985

[54] ELECTROMAGNETIC UNIT FUEL INJECTOR WITH DIFFERENTIAL VALVE

[75] Inventor: John I. Deckard, Grand Rapids, Mich.

[73] Assignee: General Motors Corporation, Detroit, Mich.

[21] Appl. No.: 530,549

[22] Filed: Sep. 9, 1983

[51] Int. Cl.[3] ..... F02M 55/02; F02M 57/02

[52] U.S. Cl. ..... 239/89; 239/124; 239/585

[58] Field of Search ..... 239/88–97, 239/124, 125, 585

[56] References Cited

U.S. PATENT DOCUMENTS

| | | | |
|---|---|---|---|
| 4,129,253 | 12/1978 | Bader, Jr. et al. | 239/88 |
| 4,211,202 | 7/1980 | Häfner | 239/88 X |
| 4,392,612 | 7/1983 | Deckard et al. | 239/88 |
| 4,463,900 | 8/1984 | Wich | 239/88 |

*Primary Examiner*—Andres Kashnikow

*Attorney, Agent, or Firm*—Arthur N. Krein

[57] ABSTRACT

An electromagnetic unit injector for use in a diesel engine includes a housing with a pump therein defined by an externally actuated plunger reciprocable in a bushing to define therewith a pump chamber open at one end for the discharge of fuel via a discharge passage means to a spring biased, pressure actuated injection nozzle. The pump chamber is supplied with fuel from a fuel chamber, containing fuel at a suitable supply pressure, via a one-way valve controlled supply passage. The discharge passage means is also in flow communication with the fuel chamber via a primary drain passage means as controlled by a differential area valve. The differential area valve, at an enlarged diameter end thereof defines, in part, a pressure control valve that is connected by a throttle orifice passage to fuel flow in the discharge passage means and, by a secondary drain passage, having a solenoid actuated control valve therein, to the fuel chamber.

3 Claims, 6 Drawing Figures

ELECTROMAGNETIC UNIT FUEL INJECTOR WITH DIFFERENTIAL VALVE

This invention relates to unit fuel injectors of the type used to inject fuel into the cylinders of a diesel engine and, in particular, to an electromagnetic unit fuel injector having a pilot controlled force balanced differential valve therein.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine driven cam whereby to pressurize fuel to a suitable high pressure so as to effect the unseating of a pressure actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in a drain passage in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow through the drain passage so as to permit the plunger to then intensify the pressure of fuel so as to effect unseating of the injection valve of the associated fuel injection nozzle.

Exemplary embodiments of such electromagnetic unit fuel injectors are disclosed, for example, in U.S. Pat. No. 4,129,253 entitled Electromagnetic Unit Fuel Injector issued Dec. 12, 1978 to Ernest Bader, Jr., John I. Deckard and Dan B. Kuiper; in U.S. Pat. No. 4,392,612 entitled Electromagnetic Unit Fuel Injector issued July 12, 1983 to John I. Deckard and Robert D. Straub; and, in U.S. patent application Ser. No. 457,417, now U.S. Pat. No. 4,463,900 entitled Electromagnetic Unit Fuel Injector filed Jan. 12, 1983, in the name of Thomas J. Wich, all assigned to a common assignee. However, in each of these exemplary embodiments, all drain flow during a pump stroke is through the drain passage as controlled by the solenoid actuated valve. Accordingly, because of the flow rates and pressures encountered, relatively large and powerful solenoids were required to effect operation of the associate control valve.

In still another form of such an electromagnetic unit injector as disclosed in U.S. Pat. No. 4,211,202 entitled Pump Nozzle for Air-Compressing Injection Internal Combustion Engine issued July 8, 1980 to Gunther Hafner, a solenoid actuated valve is used to control movement of a servo valve that is positioned to control spill flow during a pump stroke of the plunger of this unit. However, in this structure, the servo valve is positioned in the inlet fuel path to the pump chamber in a manner whereby it serves, in effect, as a throttle so as to provide an impedence to both inlet and drain flow and, accordingly, limiting the injection quality obtainable.

SUMMARY OF THE INVENTION

The present invention provides an electromagnetic unit fuel injector that includes a pump assembly having a plunger reciprocable in a bushing and operated, for example, by an engine driven cam, with flow from the pump during a pump stroke of the plunger being directed, via a high pressure passage means, to a fuel injection nozzle assembly of the unit that contains a spring biased, pressure actuated injection valve therein for controlling flow out through the spray tip outlets of the injection nozzle. A differential spool valve is operatively positioned to also control fuel flow from the high pressure passage means to a fuel drain passage means during a pump stroke and, a throttle orifice passage also interconnects the high pressure passage means to a pressure control chamber at one end of the spool valve. The pressure control chamber is also in flow communication via a solenoid valve controlled passage with the fuel drain passage means. Fuel injection is regulated by the controlled energization of the solenoid valve during a pump stroke of the plunger to allow fuel pressure in the pressure control chamber to increase so as to effect closure of the spool valve whereby to thus permit pressure intensification of fuel in the high pressure passage means to a value to effect unseating of the injection valve.

It is therefore a primary object of this invention to provide an improved electromagnetic unit fuel injector that contains a pilot controlled force balanced differential valve used to control injection.

A further object of this invention is to provide an improved electromagnetic unit fuel injector that contains a pilot controlled force balanced differential valve controlling injection whereby the differential valve allows the primary fuel bypass (non-injection mode) to spill directly into a fuel drain passage and a solenoid actuated valve being operatively positioned to, in turn, control operation of the differential valve.

Another object of the invention is to provide an improved electromagnetic unit fuel injector having a solenoid actuated control valve means incorporated therein that is operable upon energization of the solenoid to pilot pressure control the operation of a differential valve used to terminate the drain flow of fuel, as desired, during a pump stroke to thereby control the beginning and end of fuel injection.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
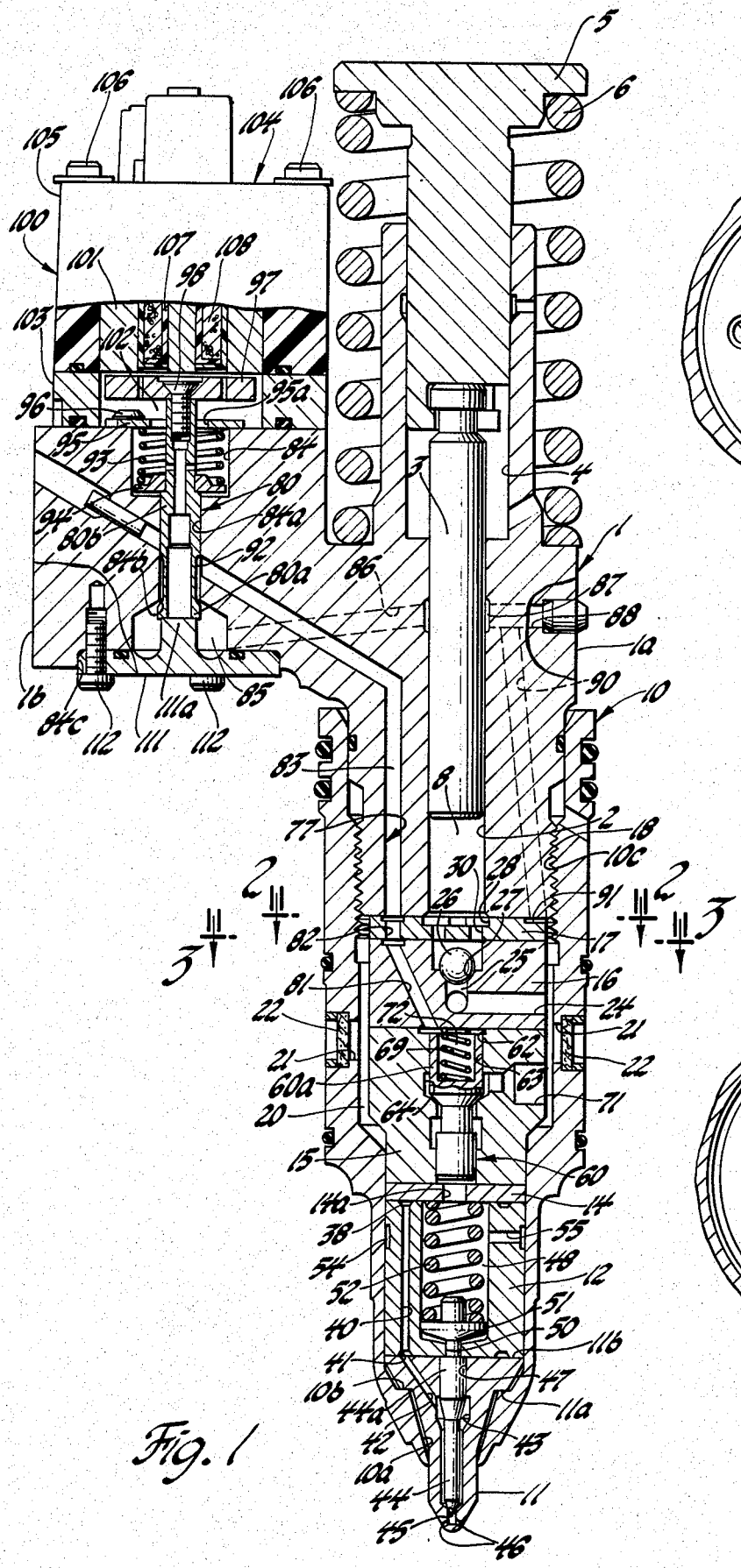
FIG. 1 is a longitudinal sectional view of an electromagnetic unit fuel injector in accordance with the invention, with elements of the injector being shown so that the plunger of the pump thereof is positioned as during a pump stroke and with the electromagnetic valve means thereof deenergized, and with parts of the unit shown in elevation.

Referring now to the drawings and, in particular, to FIG. 1, there is shown an electromagnetic unit fuel injector constructed in accordance with the invention, that is, in effect, a unit fuel injector-pump assembly with an electromagnetic actuated, pressure balanced valve incorporated therein to control fuel discharge from the injector nozzle portion of this assembly in a manner to be described.

In the construction illustrated, the electromagnetic unit fuel injector includes an injector body 1 which includes a vertical main body portion 1*a* and a side body portion 1*b*. The body portion 1*a* is provided with a stepped bore therethrough defining a cylindrical lower wall or bushing 2 of an internal diameter to slidably receive a pump plunger 3 and an upper wall 4 of a larger internal diameter to slidably receive a plunger actuator follower 5. The follower 5 extends out one end of the body 1 whereby it and the plunger connected thereto are adapted to be reciprocated by an engine driven cam or rocker, not shown, and by a plunger return spring 6 in a conventional manner. As conventional, a stop pin, not shown, would extend through an upper portion of body 1*a* into an axial groove, not shown, in the follower 5 so as to limit upward travel of the follower.

The pump plunger 3 forms with the bushing 2 a pump chamber 8 at the lower open end of the bushing 2, as shown in FIG. 1.

Forming an extension of and threaded to the lower end of the body 1 is a nut 10. Nut 10 has an opening 10*a* at its lower end through which extends the lower end of a combined injector valve body or spray tip 11, hereinafter referred to as the spray tip, of a conventional fuel injection nozzle assembly. As shown, the spray tip 11 is enlarged at its upper end to provide a shoulder 11*a* which seats on an internal shoulder 10*b* provided by the through counterbore in nut 10.

Between the spray tip 11 and the lower end of the injector body 1 there is positioned, in sequence starting from the spray tip, a rate spring cage 12, a spring retainer 14, a spool valve cage 15, a valve cage 16 and a director cage 17, these elements being formed, in the construction illustrated, as separate elements for ease of manufacturing and assembly. Nut 10 is provided with internal threads 10*c* for mating engagement with the external threads 18 at the lower end of body 1. The threaded connection of the nut 10 to body 1 holds the spray tip 11, rate spring cage 12, spring retainer 14, spool valve cage 15, valve cage 16 and director cage 17 clamped and stacked end-to-end between the upper face 11*b* of the spray tip and the bottom face of body 1. All of these above-described elements have lapped mating surfaces whereby they are held in pressure sealed relation to each other.

As best seen in FIG. 1, the director cage 17, valve cage 16 and the upper enlarged diameter end of spool valve cage 15 are each of a preselected external diameter relative to the internal diameter of the adjacent internal wall of the nut 10 whereby to define therebetween an annular chamber 20, which in a manner described in detail hereinafter serves as both a fuel supply chamber and also as the fuel drain chamber portion of a fuel drain passage means, thus the term supply/drain chamber 20 will be used hereinafter.

In the embodiment shown, the body 1 and nut 10 assembly is formed of stepped external configuration whereby this assembly and, in particular the nut 10, is adapted to be mounted in a suitable injector socket provided for this purpose in the cylinder head of an internal combustion engine, both not shown, the arrangement being such whereby fuel can be supplied to the subject electromagnetic unit fuel injector via an internal fuel rail or gallery suitably provided for this purpose in the cylinder head, in a manner known in the art.

As would be conventional, a suitable holddown clamp, not shown, would be used to retain the electromagnetic unit fuel injector in its associate injector socket in the cylinder head of an engine.

In the construction shown, the nut 10 is provided with one or more radial fuel ports or passages 21 whereby fuel, as from a fuel tank via a supply pump and conduit, can be supplied at a predetermined relative low supply pressure to the fuel supply/drain chamber 20 and whereby fuel from this fuel chamber can be drained back to a correspondingly low pressure fuel area.

In the embodiment illustrated, two such opposed radial fuel passage 21 are provided to serve for the ingress of fuel to the supply/drain chamber 20 and for the egress of fuel from this chamber. Preferably as shown, a suitable fuel filter 22 is operatively positioned in each of the fuel passages 21.

Alternatively, as is well known in the mechanical unit fuel injector art, separate fuel passages located in axial spaced apart relationship to each other can be used, if desired, to permit for the continuous separate flow of fuel into the fuel supply/drain chamber 20 and for the drain of fuel from this chamber during engine operation. Also, as is well known, either a pressure regulator or a flow orifice, not shown, would be associated with the supply/drain gallery or with separate supply and drain galleries, if used, whereby to maintain the pressure in such conduit or conduits at the predetermined relatively low supply pressure.

Fuel is supplied to the pump chamber 8 of the subject injector via a suitable one-way check valve controlled inlet passage means which in the construction shown includes one of the radial fuel passages 21, and the fuel supply/drain chamber 20. In addition, as part of this inlet passage means there is provided radial passages 24 in the valve cage 16 each of which has one end thereof in flow communication with the supply/drain chamber 20 and has its opposite end connecting with a stepped blind bore passage 25 that extends downward from the upper end of the valve cage.

In the construction shown, the upper enlarged diameter end of the blind bore passage 25 is sized so as to loosely receive a ball valve 26 which is adapted to engage an annular valve seat 27.

Figure 2:
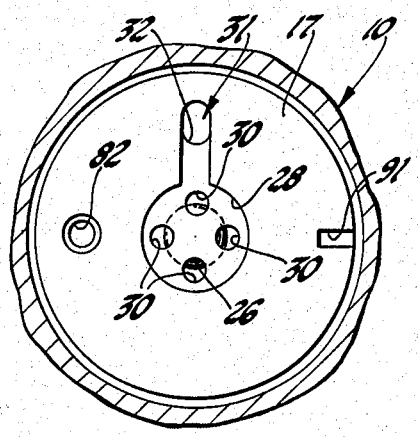
FIG. 2 is a sectional view of the electromagnetic unit fuel injector of FIG. 1 taken along line 2—2 of FIG. 1, showing the director cage, per se, of the injector.

As best seen in FIGS. 1 and 2, the director cage 17 is provided with a key-shaped recess 28 (FIG. 2) in its upper surface, that is located so that the enlarged circular portion of this recess is axially aligned with the pump chamber 8 and with circumferentially spaced apart passages 30 aligned for communication with the bored passage 25 so as to define the discharge end of the inlet passage means whereby fuel can be supplied to the pump chamber 8 during a suction stroke of the plunger 3.

Although a ball type check valve is used in the embodiment of the injector shown, it will be apparent to those skilled in the art, that any other suitable type of check valve can be used in lieu of the ball valve 26 shown.

During a pump stroke of plunger 3, fuel is discharged from pump chamber 8 into the inlet end of a high pressure passage means, generally designated 31, to be described in detail next hereinafter.

Figure 3:
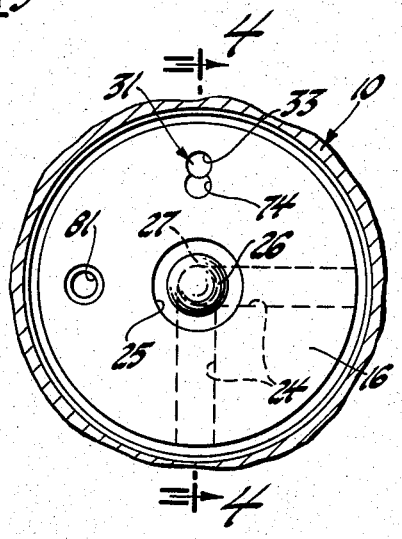
FIG. 3 is a cross-sectional view of the fuel injector of FIG. 1 taken along line 3—3 of FIG. 1, showing the spool valve cage, per se, with the ball valve removed, of the injector.
Figure 4:
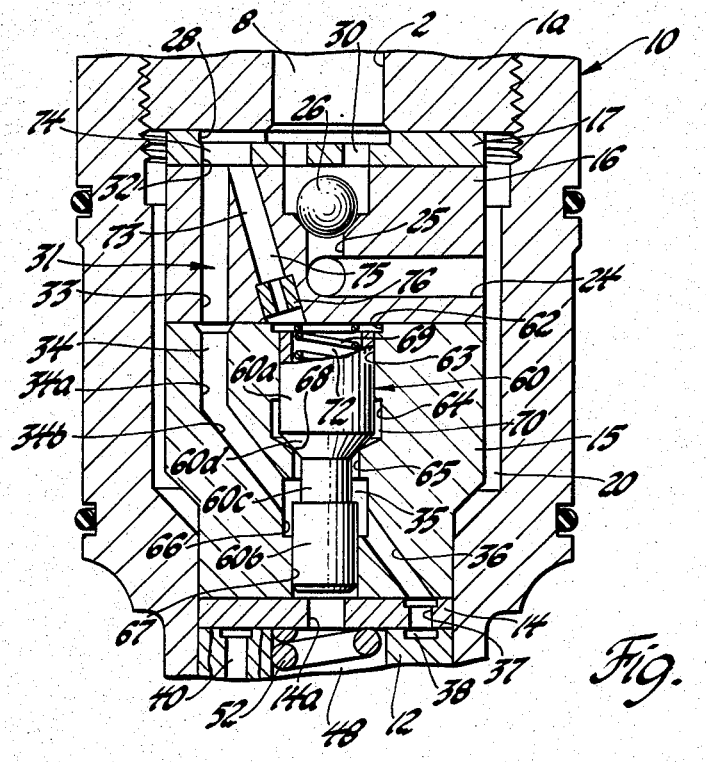
FIG. 4 is a cross-sectional view of a portion of the fuel injector of FIG. 1 taken as along line 4—4 of FIG. 3; and, FIGS. 5 and 6 are enlarged schematic functional illustrations of the primary operating elements of the fuel injector of FIG. 1 showing the Between Injection Cycle Position and the Injection Mode Position, respectively, of these elements.

An upper part of this high pressure discharge passage means 31, as best seen in FIGS. 2, 3 and 4, includes the key-hole shaped recess 28 in the director cage 17 which at the slot end thereof communicates with one end of a vertical passage 32 that extends through the director cage 17. The opposite end of passage 32 is aligned so as to communicate with one end of a vertical passage 33 extending through the valve cage 16, the opposite end of passage 33 being in flow communication with a passage, generally designated 34 provided in spool valve cage 15.

As best seen in FIG. 4, passage 34 includes a vertical portion 34*a* and an inclined portion 34*b*, the latter opening into an annulus high pressure chamber 35 described in greater detail hereinafter. An inclined passage 36 extends from chamber 35 for flow communication with one end of a vertical passage 37 that extends through the spring retainer 14 for flow communication with an annular groove 38 provided in the upper surface of the spring cage 12. This groove 38 is connected with a similar annular groove 41 on the bottom face of the spring cage 12 by a vertical passage 40 through the spring cage 12, as shown in FIG. 1.

The lower groove 41 is, in turn, connected by at least one inclined passage 42 to a central passage 43 surrounding a needle valve 44 movably positioned within the spray tip 11. At the lower end of passage 43 is an outlet for fuel delivery with an encircling tapered annular seat 45 for the needle valve 44 and, below the valve seat are connecting spray orifices 46 in the lower end of the spray tip 11.

The upper end of spray tip 11 is provided with a bore 47 for guiding opening and closing movements of the needle valve 44. The piston portion 44*a* of the needle valve slidably fits this bore 47 and has its lower end exposed to fuel pressure in passage 43 and its upper end exposed to fuel pressure in the spring chamber 48 via an opening 50, both being formed in spring cage 12. A reduced diameter upper end portion of the needle valve 44 extends through the central opening 50 in the spring cage and abuts a spring seat 51. Compressed between the spring seat 51 and spring retainer 14 is a coil spring 52 which normally biases the needle valve 44 to its closed position shown.

In order to prevent any tendency of fuel pressure to build up in the spring chamber 48, this chamber, as shown in FIG. 1, is vented through a radial port passage 55 to an annular groove 54 provided on the outer peripheral surface of spring cage 12. While a close fit exists between the nut 10 and spring cage 12, spring retainer 14 and the lower reduced diameter end of the spool valve cage 15, there is sufficient diametral clearance between these parts for the venting of fuel back to a relatively low pressure area, such as to the supply/drain chamber 20.

Now in accordance with the invention, during a pump stroke of plunger 3, pressure intensification of fuel so as to effect opening of the needle valve is controlled by means of a pilot controlled force balanced differential valve 60, to be described in detail hereinafter, which is operative to permit or block the spill flow of fuel from the high pressure passage means 31, as desired. Opening and closing movement of the differential valve 60 is, in turn, controlled by a solenoid actuated control valve, generally designated 80, to be described hereinafter.

For this purpose, the spool valve cage 15 is provided with a through stepped bore that, as shown in FIGS. 1 and 4, defines, in succession, a circular internal upper wall 62, an upper valve guide wall 63 of reduced internal diameter relative to wall 62, an upper annulus wall 64 of larger internal diameter than wall 63, an intermediate wall 65 of reduced internal diameter than wall 64, a lower annulus wall 66, and a lower valve guide wall 67. As shown in FIGS. 1 and 4, walls 65 and 67 are of reduced internal diameters relative to the diameter of the lower annulus wall 66. Walls 64 and 65 are interconnected by an inclined shoulder to define a valve seat 68.

The differential valve 60, in the form of a spool valve is slidably received in this stepped bore in the spool valve cage 15 and, in the construction shown, includes an enlarged diameter upper portion 60*a* slidably guided by valve guide wall 63 and a reduced diameter lower portion 60*b* slidably guided in lower valve guide wall 67. Extending upward from the lower portion 60*b* is a further reduced external diameter stem portion 60*c*, with the stem portion being connected to the upper portion 60*a* by a truncated conical cylinder portion 60*d* that defines a suitable valve seating surface for seating engagement with valve seat 68.

As best seen in FIGS. 1, 4, 5 and 6, the lower annulus wall 66 forms with the stem portion 60*c* of the valve 60, the annulus chamber 35 portion of the high pressure passage means 31. The upper annulus wall 64 defines with the upper portion 60*a* of the valve 60 an annulus spill chamber 70 which, as best seen in FIG. 1, is in flow communication with the supply/drain chamber 20 via a radial spill port 71. The annulus spill chamber 70 and spill port 71 define, in effect, a primary drain passage for a purpose to be described hereinafter. In addition, the upper portion 60*a* of valve 60 forms with the walls 62 and 63 a pressure control chamber 72 and, the lower portion 60*b* forms with the wall 67 a vent chamber that is in flow communication with the spring chamber 48 via a control aperture 14*a* provided in the spring retainer 14. A suitable compression spring 69 is operatively positioned in the pressure control chamber 72 to impose a light load on the spool valve 60 to affect a finite position thereof in the between injection mode to be described in detail hereinafter.

As shown in FIG. 4, the pressure control chamber 72 is in flow communication with the high pressure passage 31 by a side branch throttle orifice passage 73 which includes a vertical passage 74 in director cage 17 (FIG. 3) that extends from recess 28 to interconnect with an inclined passage 75 in the spool valve cage 16 that opens into the pressure control chamber 72, that passage 75 containing a throttle orifice 76 of predetermined flow area, as desired.

Figure 5:
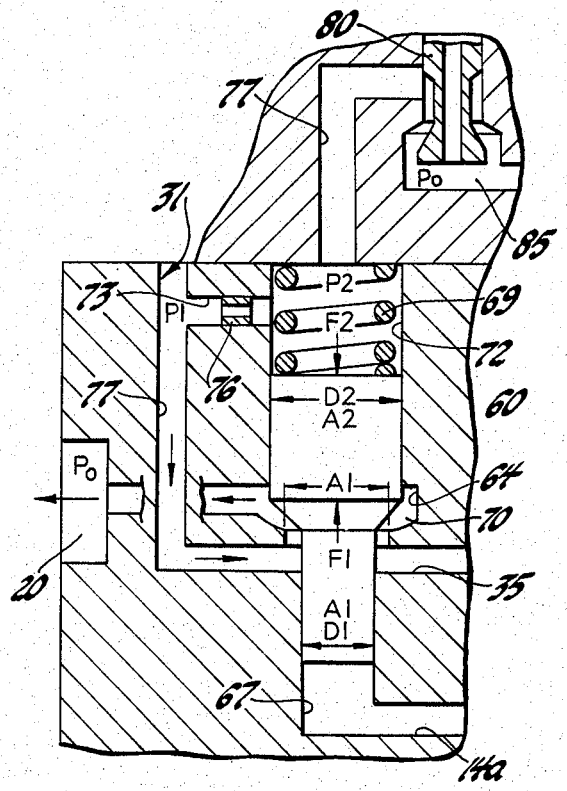

As best seen in FIG. 5, the pressure control chamber 72 is also in flow communication with a low fuel pressure area, such as supply/drain chamber 20 via a secondary drain passage means, generally designated 77, with drain flow through this secondary drain passage means 77 being controlled by a suitable, normally open solenoid actuated control valve generally designated 80. In the embodiment illustrated, the solenoid actuated control valve 80 is of the type disclosed in the above-identified U.S. patent application Ser. No. 350,267, now U.S. Pat. No. 4,392,612, the disclosure of which is incorporated herein by reference thereto.

In the construction illustrated and with reference to FIG. 1, this drain passage means 77 includes, starting from the pressure control chamber 72, an upwardly inclined passage 81 in valve body 16 that communicates at its lower end with chamber 72 and at its upper end with a passage 82 extending through director cage 17 so as to be in flow alignment with the lower end of a suitable drain passage 83 provided in body 1. At its upper end, the drain passage 83 opens through a valve guide wall 84*a* provided by a stepped bore 84 formed in the side body 1*b*. This stepped bore 84 is formed so that the lower end of the valve guide wall 84*a* opens into a spill cavity 85, with an annular valve seat 84*b* encircling the lower end of the guide wall 84*a*.

Spill cavity 85 is, in turn, in flow communication via a passage 86 to an annular groove 87, formed in cylinder wall 2 so as to encircle plunger 3, and then via a radial passage 88 and an downward inclined passage 90 with the supply/drain chamber 20. To insure unrestricted flow from passage 90 to supply/drain chamber 20, an aligned radial extending groove 91 is provided in the upper surface of the director cage 17 (FIGS. 1 and 2).

As is well known in the art, locating pins, such as dowels, would be positioned in suitably located guide holes, both not shown, so as to maintain the desired angular alignment of the spring retainer 14, spool valve cage 15, valve cage 16, director cage 17 and the body 1 relative to each other in the manner illustrated.

Flow from the passage 83 to the spill cavity 85 is controlled by the control valve 80 which is in the form of a hollow, pressure balanced poppet valve having a head 80*a* adapted to seat against valve seat 84*b* at its interconnecting edge with valve guide wall 84*a* and, a stem 80*b* slidably guided in the valve guide wall 84*a*. A portion of the stem 80*b* next adjacent to the head 80*a* is of reduced diameter and of an axial extent so as to form with the valve guide wall 84*a* an annulus cavity 92 that is always in flow communication with passage 83 during opening and closing movement of control valve 80.

The control valve 80 is normally biased in a valve opening direction, downward with reference to FIG. 1, by means of a coil spring 93 loosely encircling an intermediate upper end portion of the valve stem 80*b* with one end of the spring in abutment against a washer-like spring retainer 94 on the control valve 80 and its other end in abutment against a spring retainer 95 fixed as by screws 96 to the upper surface of the side body portion 1*b* concentric with bore 84. The upper free end of the valve stem 80*b* extends loosely through a central aperture 95*a* in the spring retainer 95 and has the armature 94 of a solenoid assembly, generally designated 100, fixed thereto as by a screw 98.

As seen in FIG. 1, the armature 97 is loosely received in the complementary shaped armature cavity 102 provided in a solenoid spacer 103 for movement relative to an associate pole piece 101 of the solenoid assembly.

As shown, the solenoid assembly 100 further includes a stator assembly, generally designated 104, having a flanged inverted cup-shaped solenoid case 105, made for example, of a suitable plastic such as glass filled nylon, which is secured as by screws 106 to the upper surface of the side body portion 1*b*, with the solenoid spacer 103 sandwiched therebetween, in position to encircle the spring retainer 95 and bore 84. A coil bobbin 107, supporting a wound solenoid coil 108 and, a segmented multi-piece pole piece 101 are supported within the solenoid case 105.

In the construction illustrated, the lower surface of the pole piece 101 is aligned with the lower surface of the solenoid case 105, as shown in FIG. 1. With this arrangement, the thickness of the solenoid spacer 103 is preselected relative to the height of the armature 97 above the upper surface of the side body portion 1*b*, when control valve 80 is in its closed position, so that a clearance exists between the upper working surface of the armature and the plane of the upper surface of the solenoid spacer whereby a minimum working air gap will exist between the opposed working faces of the armature and pole piece.

As would be conventional, the solenoid coil 108 is adapted to be connected to a suitable source of electrical power via a fuel injection electronic control circuit, not shown, whereby the solenoid coil can be energized as a function of the operating conditions of an associated engine in a manner well known in the art.

In the construction shown, the spill cavity 85 is defined in part by a closure cap 111, of a suitable diameter so as to be received in the lower bore wall 84*c*, is secured to the side body 1*b* as by screws 112. In addition the closure cap 111 is provided with a central upstanding boss 111*a* of predetermined height whereby to limit opening travel movement of the control valve 80.

Although the illustrated and above-described solenoid actuated control valve 80 is a pressure balanced valve of the type disclosed in the above-identified application Ser. No. 350,267, it will be appreciated by those skilled in the art, that a solenoid actuated non-pressure balanced type poppet valve of the type disclosed in the above-identified application Ser. No. 457,417 or a solenoid actuated needle valve of the type disclosed in the above-identified Pat. No. 4,129,253 can be used in lieu of this pressure balanced valve.

FUNCTIONAL DESCRIPTION

Referring now in particular to FIG. 1, during engine operation, fuel from a fuel tank, not shown, is supplied at a predetermined supply pressure Po by a pump, not shown, to the subject electromagnetic unit fuel injector through for example a fuel supply gallery, not shown, in flow communication with one of the ports 21 in the nut 10 of the injector. Fuel as thus delivered through a port 21 flows into the supply/drain chamber 20.

Thus during a suction stroke of the plunger 3, fuel can then flow from the supply/drain chamber 20 via radial passages 24 and valve 26 controlled bore passage 25 into the pump chamber 8. At the same time, fuel will be present in the high pressure passage means 31, throttle orifice passage 73 and pressure control chamber 72, and in the primary and secondary drain passage means (70,71) and 77, respectively.

Thereafter, as the follower 5 is driven downward, as by a cam or rocker arm, not shown, to effect downward movement of the plunger 3 on a pump stroke, this movement of the plunger will cause fuel to be displaced from the pump chamber 8 and effect an increase of the pressure of fuel in this chamber and in the high pressure passage means 31.

Figure 6:
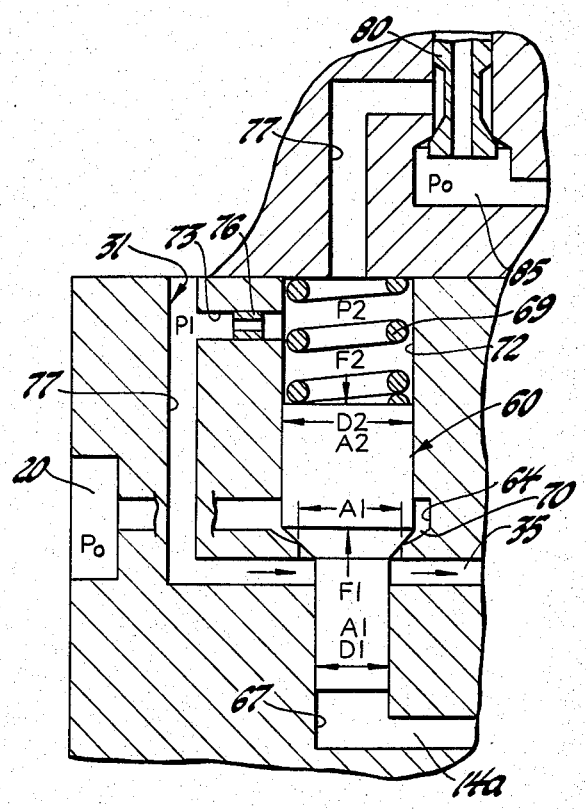

Referring now to the functional diagrams of FIGS. 5 and 6, FIG. 5 shows the position of the differential valve 60 and of the solenoid actuated control valve 80 in the between injection cycle or spill mode (non-injection mode) while FIG. 6 shows the position of these elements during an injection mode, both as during a pump stroke of the plunger 3.

As shown in FIG. 5, in the between injection mode, with the solenoid coil 108 deenergized, the control valve 80 is in an open position relative to valve seat 84*b* so as to permit the drain of fuel from the pressure control chamber 72 via the secondary drain passage means to a low supply/drain pressure Po area, such as to supply/drain chamber 20 via the primary drain passage means 70,71.

Accordingly, during this pump stroke of plunger 3, the pressure of fuel in the high pressure passage means 31 will be increased to a pressure P1, a pressure value greater than the supply pressure Po, as a function of plunger velocity.

This pressurized fuel in the high pressure passage means 31 will also flow via the throttle orifice passage 73 into the pressure control chamber 72 and then flow from this chamber 72 to drain at a; controlled rate so that fuel in the pressure control chamber 72 will be at a pressure P2. However, during this between injection cycle, the pressure P1 will always be greater than pressure P2 as fuel flow is throttled by the throttle orifice 76 in the throttle orifice passage 73 and the throttle orifice defined by the annular opening between the head 80*a* of the control valve 80 and valve seat 84*b*.

This throttle ratio and the diameter D2 of the differential spool valve 60 relative to the diameter of the spool valve seating surface are preselected so the force F1 (FIG. 5) acting to open the spool valve 60 is greater than the force F2 opposing opening movement of the spool valve 60. The force of spring 69 merely helps to limit opening movement of the spool valve.

These forces are calculated as follows:

$$F1 = P1\ (A2 - A1)$$

$$F2 = P2\ (A2)$$

thus in this mode force F1 is always greater than force F2.

In this between injection cycle or spill mode, with the differential valve 60 open to permit flow communication between annulus chamber 35, fuel from the high pressure passage means 31 will be bypassed directly to, in effect, the low supply pressure fuel area in chamber 20 via the primary drain passage means described, so that, in this spill mode, the pressure P1 will always be less than that required to effect opening of the needle valve 44.

The injection mode shown in FIG. 6 is initiated by energization of the solenoid coil 108 whereby to effect closure of the control valve 80. With this control valve 80 closed, the position shown in FIG. 6, the pressure P2 in the pressure control chamber 72 rapidly approaches the pressure P1 and, since D2 is larger than D1, therefore the force F2 will be greater than that of force F1 and, accordingly, the spool valve 60 will move to its closed position, the position shown in FIG. 6. As this occurs, the high pressure passage means 31 is, in effect, captivated so that continued downward movement of the plunger 3 will effect intensification of the pressure P1 to a value whereby to effect the unseating of the needle valve 44 so as to initiate injection.

Upon deenergization of the solenoid coil 108, injection will terminate rapidly since the pressure P2 in the pressure control chamber 72 will then again be dumped via the now open, control valve 80 to drain pressure Po, so that once again P1 will be greater than P2 to thus allow the spool valve 60 to rapidly move to its open position, the position shown in FIG. 5. As this occurs the pressure P1 in the high pressure passage means 31 is dumped to supply/drain pressure Po in the manner previously described. Injection is thus rapidly terminated as the pressure P1 becomes less than the nozzle valve closing pressure.

It should now be apparent that by the use of the pilot pressure controlled, differential diameter spool valve 60 disclosed, the volume of fuel in the high pressure injection system portion of this injection can be substantially reduced relative to other known type electromagnetic unit injectors. Thus the subject injector, by virtue of the reduced volume in the high pressure injection system, will be operative so as to produce a higher rate of injection in the upper RPM operating range of an associated engine whereby to permit optimization of the engine performance factor. As should now be apparent, reduction in the volume of fuel in the high pressure injection system contributes to less fluid inertness; reduction in the system fluid capacitance; and, reduction in fluid resistance.

The use of the differential valve allows the secondary drain passage means 83, the control valve 80 and associated solenoid assembly 100 to be miniaturized since these elements are merely used in the subject unit injector to only modulate pressure in the pressure control chamber 72.

The incorporation of the differential valve in a subject unit injector in accordance with the subject invention, allows the primary fuel bypass (non-injection mode) to spill directly as into an engine block fuel gallery, thus optimizing the injection characteristic pressure decay rate to maximize the reduction of emission hydrocarbons during engine operation. Factors contributing to this improved injection decay rate include those indicated above (less fuel inertness, capacitance, and resistance) since the primary fuel spill is direct, that is, it does not have to flow through a relatively long injector body passage, magnetically operated control valve, and other drain passages to spill into a fuel return conduit as, for example, in the manner shown in the above-identified U.S. Pat. No. 4,129,253.

Thus in accordance with the subject invention, the function of the solenoid (electromagnetically) actuated control valve drain system (secondary drain passage means) is pilot pressure control while the function of the differential spool valve is fuel drain flow control during a pump stroke of the associate plunger.

While the present invention, as to objects and advantages, has been described herein as carried out in a specific embodiment thereof, it is not desired to be limited thereby but is intended to cover the invention broadly within the spirit and scope of the following claims.

The embodiments of the invention in which an exclusive property or privilege is claimed are defined as follows:

1. An electromagnetic unit fuel injector including a housing means having a pump cylinder means therein; an externally actuated plunger reciprocable in said cylinder means to define therewith a pump chamber open at one end for the discharge of fuel during a pump stroke and for fuel intake during a suction stroke of said plunger; a valve controlled passage means in flow communication at one end with said pump chamber and connectable at its other end to a source of fuel at a suitable supply pressure; said housing means including a valve body having a spray outlet at one end thereof for the discharge of fuel; an injection valve means movable in said valve body to control flow through said spray outlet; a discharge passage means connecting said pump chamber to said spray outlet; a drain passage means connectable at one end to a source of fuel at a suitable supply pressure; a stepped valve guide bore means in said housing means intersecting a portion of each said discharge passage means and said drain passage means and defining an annular valve seat therebetween; a differential valve slidably movable in said guide bore means between an open position and a closed position relative to said valve seat, the larger diameter end of said differential valve defining with a corresponding sized portion of said guide bore means a pressure control chamber, said discharge passage means including branch passage means with a flow control orifice therein opening into said pressure control chamber; and, a solenoid actuated valve controlled passage means for effecting flow communication between said pressure control chamber and said drain passage means.

2. An electromagnetic unit fuel injector including a housing means having a pump cylinder means therein; an externally actuated plunger reciprocable in said cylinder means to define therewith a pump chamber open at one end for the discharge of fuel during a pump stroke and for fuel intake during a suction stroke of said plunger; a valve controlled supply passage means in flow communication at one end with said pump chamber and connectable at its other end to a source of fuel at a suitable supply pressure; said housing means including a valve body having a valve controlled spray outlet means at one end thereof for the discharge of fuel; a discharge passage means connecting said pump chamber to said spray outlet; a primary drain passage means connectable at one end to a source of fuel at a suitable supply pressure; a stepped valve guide bore means in said housing means intersecting a portion of each said discharge passage means and said primary drain passage means and defining an annular valve seat therebetween; a differential valve slidably movable in said guide bore means between an open position and a closed position relative to said valve seat, the larger diameter end of said differential valve defining with a corresponding sized portion of said guide bore means a pressure control chamber, said discharge passage means including branch passage means with a flow control orifice therein opening into said pressure control chamber; and, a solenoid actuated valve controlled secondary drain passage means having a flow control orifice therein for effecting flow communication between said pressure control chamber and said primary drain passage means.

3. An electromagnetic unit fuel injector including a housing means having a pump cylinder means therein; an externally actuated plunger reciprocable in said cylinder means to define therewith a pump chamber open at one end for the discharge of fuel during a pump stroke and for fuel intake during a suction stroke of said plunger; a one-way valve controlled supply passage means in flow communication at one end with said pump chamber and connectable at its other end to a source of fuel at a suitable supply pressure; said housing means including a valve body having a spray outlet at one end thereof for the discharge of fuel; an injection valve means movable in said valve body to control flow through said spray outlet; a discharge passage means connecting said pump chamber to said spray outlet; a primary drain passage means connectable at one end to a source of suitable supply pressure; a stepped valve guide bore means in said housing means intersecting a portion of each said discharge passage means and said drain passage means and defining an annular valve seat therebetween; a stepped diameter spool valve slidably movable in said guide bore means between an open position and a closed position relative to said valve seat, the larger diameter end of said spool valve defining with a corresponding sized portion of said guide bore means a pressure control chamber, said discharge passage means including branch passage means with a flow control orifice therein opening into said pressure control chamber; a secondary drain passage means in flow communication at one end with said pressure control chamber and at its other end in operable flow communication with said primary drain passage means and passage means for controlling flow therethrough.

* * * * *